US009406265B2

(12) United States Patent
Kim et al.

(10) Patent No.: US 9,406,265 B2
(45) Date of Patent: Aug. 2, 2016

(54) DISPLAY APPARATUS AND METHOD OF DRIVING THE DISPLAY APPARATUS

(71) Applicant: Samsung Display Co., Ltd., Yongin, Gyeonggi-Do (KR)

(72) Inventors: Byung-Sun Kim, Seoul (KR); Nam-Gon Choi, Yongin-si (KR); Hong-Soo Kim, Hwaseong-si (KR); Ja-Kyoung Jin, Daegu (KR); Jung-Won Kim, Seoul (KR); Cheol-Woo Park, Suwon-si (KR)

(73) Assignee: Samsung Display Co., Ltd., Giheung-Gu, Yongin-si, Gyeonggi-Do (KR)

( * ) Notice: Subject to any disclaimer, the term of this patent is extended or adjusted under 35 U.S.C. 154(b) by 24 days.

(21) Appl. No.: 14/551,687

(22) Filed: Nov. 24, 2014

(65) Prior Publication Data

US 2016/0027390 A1 Jan. 28, 2016

(30) Foreign Application Priority Data

Jul. 23, 2014 (KR) ..... 10-2014-0093571

(51) Int. Cl.
*G09G 3/36* (2006.01)

(52) U.S. Cl.
CPC ..... *G09G 3/3607* (2013.01); *G09G 3/3648* (2013.01); *G09G 2320/0276* (2013.01); *G09G 2320/0673* (2013.01)

(58) Field of Classification Search
CPC ..... G09G 3/3607; G09G 2320/0673; G09G 2320/0276; G09G 3/3648
See application file for complete search history.

(56) References Cited

U.S. PATENT DOCUMENTS

| | | | | |
|---|---|---|---|---|
| 6,606,093 | B1 * | 8/2003 | Gossett | G06T 11/203 345/4 |
| 7,084,845 | B2 | 8/2006 | Hong | |
| 7,280,103 | B2 | 10/2007 | Taoka et al. | |
| 8,063,863 | B2 | 11/2011 | Yano et al. | |
| 2003/0095287 | A1 * | 5/2003 | Miyagi | G06T 5/20 358/2.1 |
| 2005/0134614 | A1 * | 6/2005 | Tomohara | G09G 3/2014 345/690 |
| 2011/0249895 | A1 * | 10/2011 | Lin | G06T 5/30 382/167 |

FOREIGN PATENT DOCUMENTS

| | | |
|---|---|---|
| JP | 2009-071873 | 4/2009 |
| JP | 2013-165476 | 8/2013 |
| KR | 10-2008-0054190 | 6/2008 |

* cited by examiner

*Primary Examiner* — Ariel Balaoing
(74) *Attorney, Agent, or Firm* — Robert E. Bushnell, Esq.

(57) ABSTRACT

A display apparatus having an edge determiner configured to determine an edge area of the moving object based on moving direction and moving speed corresponding to the moving vector. The display apparatus also includes a gamma output controller configured to output normal high data of a high gamma curve and normal low data of a low gamma curve as gamma data of input data corresponding to a remaining area except for the edge area, and to output enhanced high data of the high gamma curve and enhanced low data of the low gamma curve as gamma data of input data corresponding to the edge area, in both time division method and space division method based on a spatiotemporal sequential pattern.

20 Claims, 10 Drawing Sheets

| INPUT DATA (DIN) | OUTPUT DATA(DOUT) | |
|---|---|---|
| | HIGH DATA(N_H) | LOW DATA(N_L) |
| 0G | 0G | 0G |
| 32G | 64G | 0G |
| 63G | 109G | 0G |
| 95G | 157G | 0G |
| 127G | 213G | 44G |
| 159G | 239G | 77G |
| 191G | 251G | 246G |
| 223G | 253G | 250G |
| 255G | 255G | 255G |

< NORMAL GAMMA LUT >

FIG. 3

| Temporal Pattern(4 Frame) | | | | |
|---|---|---|---|---|
| | F1 | F2 | F3 | F4 |
| A Seq | H | L | H | L |
| B Seq | L | H | L | H |

| Spatial Pattern (4x4 Pixels) | | | | | | | | | | | | | |
|---|---|---|---|---|---|---|---|---|---|---|---|---|---|
| | | Column | | | | | | | | | | | |
| | | C1 | | | C2 | | | C3 | | | C4 | | |
| Row | R1 | A | A | A | A | A | A | A | A | A | A | A | A |
| | R2 | B | B | B | B | B | B | B | B | B | B | B | B |
| | R3 | A | A | A | A | A | A | A | A | A | A | A | A |
| | R4 | B | B | B | B | B | B | B | B | B | B | B | B |

TSP

U

SP1 SP3 SP4 SP2

| INPUT DATA (DIN) | OUTPUT DATA(DOUT) | |
|---|---|---|
| | HIGH DATA(N_H) | LOW DATA(N_L) |
| 0G | 0G | 0G |
| 32G | 64G | 0G |
| 63G | 109G | 0G |
| 95G | 157G | 0G |
| 127G | 213G | 44G |
| 159G | 239G | 77G |
| 191G | 251G | 246G |
| 223G | 253G | 250G |
| 255G | 255G | 255G |

< NORMAL GAMMA LUT >

FIG. 4C

| INPUT DATA (DIN) | OUTPUT DATA(DOUT) | |
|---|---|---|
| | HIGH DATA(E_H) | LOW DATA(E_L) |
| 0G | 0G | 0G |
| 32G | 0G | 0G |
| 63G | 30G | 0G |
| 95G | 70G | 0G |
| 127G | 213G | 44G |
| 159G | 249G | 200G |
| 191G | 253G | 230G |
| 223G | 255G | 251G |
| 255G | 255G | 255G |

< ENHANCEMENT GAMMA LUT >

DISPLAY APPARATUS AND METHOD OF DRIVING THE DISPLAY APPARATUS

This application makes reference to, incorporates the same herein, and claims all benefits accruing under 35 U.S.C. §119 from an application earlier filed in the Korean Intellectual Property Office on 23 Jul. 2014 and there duly assigned Serial No. 10-2014-0093571.

BACKGROUND OF THE INVENTION

1. Field of the Invention

Exemplary embodiments of the inventive concept relate to a display apparatus and a method of driving the display apparatus. More particularly, example embodiments of the inventive concept relate to a display apparatus for improving a display quality and a method of driving the display apparatus.

2. Description of the Related Art

A liquid crystal display (LCD) panel may include a thin film transistor (TFT) substrate, an opposing substrate and an LC layer disposed between the two substrates. The TFT substrate may include a plurality of gate lines, a plurality of data lines crossing the gate lines, a plurality of TFTs connected to the gate lines and the data lines, and a plurality of pixel electrodes connected to the TFTs. A TFT may include a gate electrode extended from a gate line, a source electrode extended to a data line, and a drain electrode spaced apart from the source electrode.

The LCD panel may not emit light by itself. In other words, it is not self-emissive. The LCD panel may receive light from the backside of the LCD panel or from the front of the LCD panel. The LCD panel may have limited side visibility. To improve the side visibility, a multi-domain technique may be used. In the multi-domain technique, an area in which a pixel electrode is formed is divided into a plurality of domains, and LC molecules of the LC layer are arranged according to the domain in which they are located.

The above information disclosed in this Related Art section is only for enhancement of understanding of the background of the invention and therefore it may contain information that does not form the prior art that is already known to a person of ordinary skill in the art.

BRIEF SUMMARY OF THE INVENTION

Exemplary embodiments of the inventive concept provide a display apparatus for improving a display quality.

Exemplary embodiments of the inventive concept provide a method of driving the display apparatus.

According to an exemplary embodiment of the inventive concept, there is provided a display apparatus. The display apparatus may include a display panel comprising a data line, a gate line crossing the data line and a sub pixel connected to the data line and the gate line, a moving vector extractor configured to extract a moving vector of a moving object included in a frame image using input data, an edge determiner configured to determine an edge area of the moving object based on moving direction and moving speed corresponding to the moving vector, a gamma output controller configured to output normal high data of a high gamma curve and normal low data of a low gamma curve as gamma data of input data corresponding to a remaining area except for the edge area, and to output enhanced high data of the high gamma curve and enhanced low data of the low gamma curve as gamma data of input data corresponding to the edge area, in both time division method and space division method based on a spatiotemporal sequential pattern, and a data driver circuit configured to covert the gamma data provided from the gamma output controller into a data voltage to provide the data line with the data voltage, wherein an enhanced data difference between the enhanced high data and the enhanced low data is equal to or less than a normal data difference between the normal high data and the normal low data with respect to a same grayscale.

In an exemplary embodiment, the display apparatus may further include a sequential pattern storage configured to store the spatiotemporal sequential pattern, a normal gamma look up table (LUT) configured to store the normal high data of the high gamma curve and the normal low data of the low gamma curve, and an enhancement gamma LUT configured to store the enhanced high data of the high gamma curve and the enhanced low data of the low gamma curve.

In an exemplary embodiment, when the input data has a grayscale higher than a reference grayscale having a maximum luminance difference between the high gamma curve and the low gamma curve, the enhanced high data may have a grayscale higher than the normal high data and the enhanced low data may have a grayscale higher than the normal low data.

In an exemplary embodiment, when the input data have a grayscale lower than the reference grayscale, the enhanced high data may have a grayscale lower than the normal high data and the enhanced low data may have a grayscale lower than the normal low data.

In an exemplary embodiment, the display apparatus may further include a doubling processor configured to repeat the input data by a frame period, and to output an original data frame and a repeated data frame substantially equal to the original data frame.

In an exemplary embodiment, when the input data correspond to the repeated data frame, the gamma output controller may be configured to output the normal high data of the high gamma curve and the normal low data of the low gamma curve as gamma data of the input data corresponding to the edge area in both time division method and space division method based on the spatiotemporal sequential pattern.

In an exemplary embodiment, when the input data correspond to the original data frame, the gamma output controller may be configured to output the normal high data of the high gamma curve and the normal low data of the low gamma curve as gamma data of input data corresponding to a remaining area except for the edge area, and to output the enhanced high data of the high gamma curve and the enhanced low data of the low gamma curve as gamma data of input data corresponding to the edge area, in both time division method and space division method based on the spatiotemporal sequential pattern.

In an exemplary embodiment, the doubling processor may be configured to receive data with a frame frequency of 60 Hz and output data with a frame frequency of 120 Hz.

In an exemplary embodiment, the moving speed of the moving object may be 1 ppf (pixel per frame) with respect to the frame frequency of 60 Hz and is 2 ppf with respect to the frame frequency of 120 Hz.

In an exemplary embodiment, the spatiotemporal sequential pattern mat include a spatial pattern which has an array of the high and low data corresponding to a plurality of sub pixels arranged in an (n×m) matrix array, and a temporal pattern which has a sequence of the high and low data corresponding to the sub pixels during k frames ('n', 'm' and 'k' are natural numbers).

In an exemplary embodiment, the spatiotemporal sequential pattern may correspond to first to fourth sub pixels arranged in a (2×2) matrix array, a first sub pixel and a second sub pixel adjacent to the first sub pixel in a row direction may have a first sequence with respect to high data (H) of the high gamma curve and low data (L) of the low gamma curve during a plurality of frames, and a third sub pixel adjacent to the first sub pixel in a column direction and a fourth sub pixel adjacent to the third sub pixel in the row direction may have a second sequence with respect to the high data (H) of the high gamma curve and the low data (L) of the low gamma curve during a plurality of frames.

In an exemplary embodiment, the first sequence may have a sequence as "H→L→H→L" with respect to the high and low data (H and L) during 4 frames, and the second sequence may have a sequence as "L→H→L→H" with respect to the high and low data (H and L) during 4 frames.

According to an exemplary embodiment of the inventive concept, there is provided a method of driving a display apparatus. The method may include extracting a moving vector of a moving object included in a frame image using input data, determining an edge area of the moving object based on moving direction and moving speed corresponding to the moving vector, outputting normal high data of a high gamma curve and normal low data of a low gamma curve as gamma data of input data corresponding to a remaining area except for the edge area in both time division method and space division method based on a spatiotemporal sequential pattern, outputting enhanced high data of the high gamma curve and enhanced low data of the low gamma curve as gamma data of input data corresponding to the edge area in both time division method and space division method based on the spatiotemporal sequential pattern, and converting the gamma data into a data voltage to provide the data line with the data voltage, wherein an enhanced data difference between the enhanced high data and the enhanced low data is less than a normal data difference between the normal high data and the normal low data with respect to the input data of a same grayscale.

In an exemplary embodiment, when the input data has a grayscale higher than a reference grayscale having a maximum luminance difference between the high gamma curve and the low gamma curve, the enhanced high data may have a grayscale higher than the normal high data and the enhanced low data has a grayscale higher than the normal low data.

In an exemplary embodiment, when the input data may have a grayscale lower than the reference grayscale, the enhanced high data has a grayscale lower than the normal high data and the enhanced low data has a grayscale lower than the normal low data.

In an exemplary embodiment, the method may further include repeating the input data by a frame period to output an original data frame and a repeated data frame substantially equal to the original data frame.

In an exemplary embodiment, when the input data are data of the repeated data frame, the normal high data of the high gamma curve and the normal low data of the low gamma curve may be outputted as gamma data of the input data corresponding to the edge area in both time division method and space division method based on the spatiotemporal sequential pattern.

In an exemplary embodiment, the original data frame and the repeated data frame may be outputted with a frame frequency of 120 Hz.

In an exemplary embodiment, the moving speed of the moving object may be 1 ppf (pixel per frame) with respect to the frame frequency of 60 Hz and may be 2 ppf with respect to the frame frequency of 120 Hz.

In an exemplary embodiment, the spatiotemporal sequential pattern may correspond to first to fourth sub pixels arranged in a (2×2) matrix array, a first sub pixel and a second sub pixel adjacent to the first sub pixel in a row direction may have a first sequence with respect to high data (H) of the high gamma curve and low data (L) of the low gamma curve during 4 frames, the first sequence having a sequence as "H→L→H→L", and a third sub pixel adjacent to the first sub pixel in a column direction and a fourth sub pixel adjacent to the third sub pixel in the row direction may have a second sequence with respect to the high data (H) of the high gamma curve and the low data (L) of the low gamma curve during 4 frames, the second sequence having a sequence as "L→H→L→H".

According to the inventive concept, a luminance difference between the enhanced high data and the enhanced low data applied to the gamma data corresponding to the edge area of the moving object may be decreased and thus, the luminance difference in the edge area of the moving object may be decreased. Therefore, the Moving Artifact such as a Checker defect may be prevented from being observed in the edge area.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein:

FIG. 3 is conceptual diagram illustrating a sequential pattern storage of FIG. 2 according to an exemplary embodiment;

FIGS. 4A to 4C are conceptual diagrams illustrating an enhancement gamma LUT and a normal gamma LUT of FIG. 2 according to an exemplary embodiment;

DETAILED DESCRIPTION OF THE INVENTION

Figure 1:
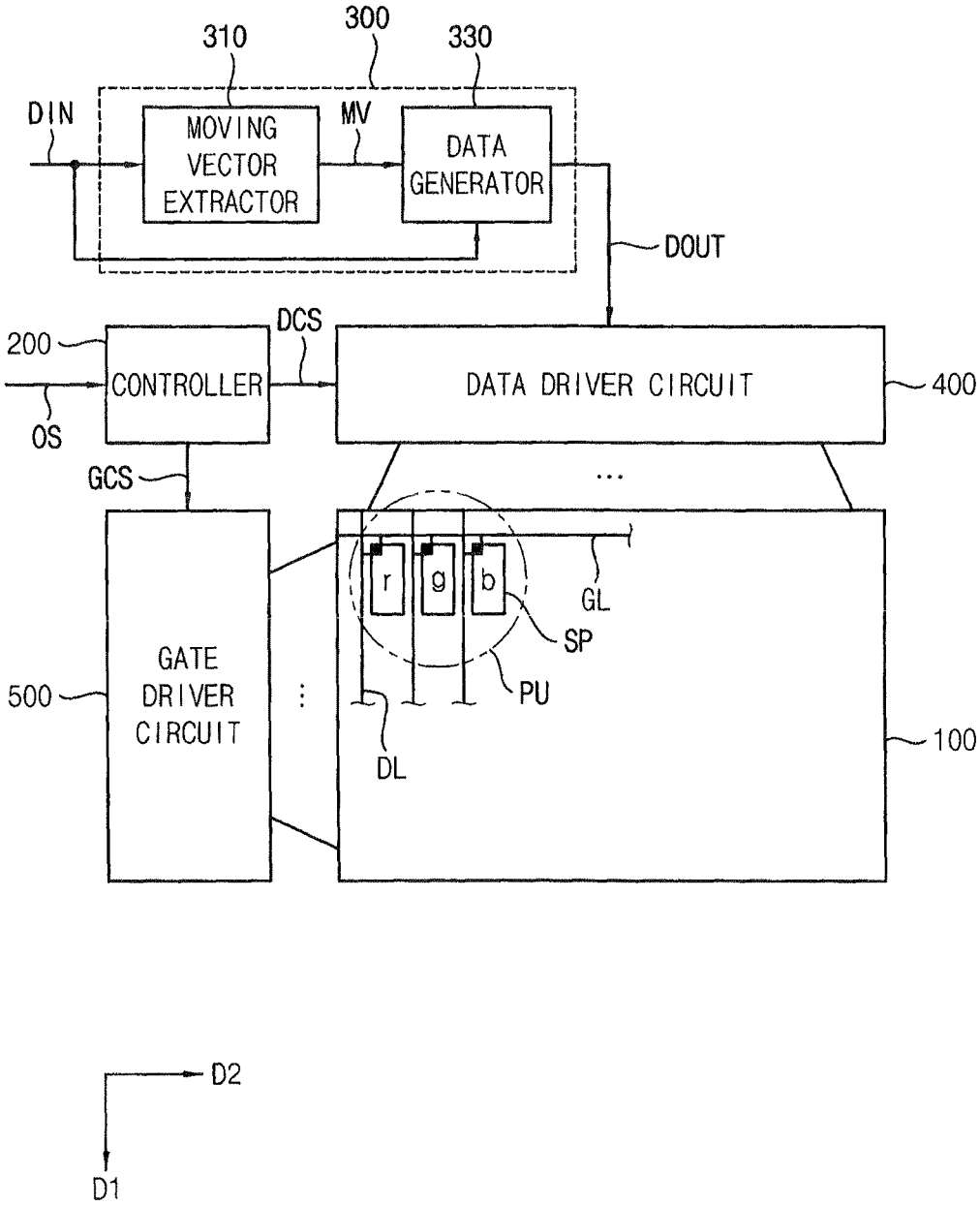
FIG. 1 is a block diagram illustrating a display apparatus according to an exemplary embodiment.

Hereinafter, the inventive concept will be explained in detail with reference to the accompanying drawings. The inventive concept may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display apparatus according to an exemplary embodiment.

Referring to FIG. 1, the display apparatus may include a display panel 100, a controller 200, a gamma data generator 300, a data driver circuit 400 and a gate driver circuit 500.

The display panel 100 may include a plurality of data lines DL, a plurality of gate lines GL and a plurality of pixel units PU. The data lines DL extend in a first direction D1 and are arranged in a second direction D2 crossing the first direction D1. The gate lines GL extend in the second direction D2 and are arranged in the first direction D1. The pixel units PU are arranged as a matrix array which may include a plurality of pixel rows and a plurality of pixel columns. Each of the pixel units PU may include a plurality of sub pixels SP. For example, the pixel unit PU may include a red sub pixel r, a green sub pixel g and a blue sub pixel b.

The controller 200 generally controls an operation of the display apparatus. The controller 200 may be configured to receive an original synch signal OS, and to generate a plurality of control signals for driving the display panel 100 based on the original synch signal OS. The control signals may include a data control signal DCS for controlling the data driver circuit 300 and a gate control signal GCS for controlling the gate driver circuit 400.

The data control signal DCS may include a horizontal synch signal, a vertical synch signal, a data enable signal, a polarity control signal and so on. The gate control signal GCS may include a vertical start signal, a gate clock signal, an output enable signal and so on.

The gamma data generator 300 may include a moving vector extractor 310 and a data generator 330.

The moving vector extractor 310 may be configured to extract a moving vector MV of an object included in a frame image using input data DIN. For example, the moving vector extractor 310 may be configured to compare current frame data with previous frame data and to extract the moving vector MV of the moving object included in a current frame image. The moving vector MV may be calculated by various algorithm such as a Motion Estimation Motion Compensation (MEMC) algorithm.

The data generator 330 may be configured to determine an edge area of the moving object based on the moving vector MV. The data generator 330 may be configured to output enhanced high data of a high gamma curve and enhanced low data of a low gamma curve in both time division method and space division method as gamma data DOUT of the input data DIN corresponding to the edge area.

The data generator 330 may be configured to output normal high data of the high gamma curve and normal low data of the low gamma curve in both time division method and space division method based on the spatiotemporal sequential pattern as gamma data DOUT of the input data corresponding to a remaining area except for the edge area. An enhanced data difference between the enhanced high data and the enhanced low data is equal to or less than a normal data difference between the normal high data and the normal low data with respect to the input data of a same grayscale.

The spatiotemporal sequential pattern may include a spatial pattern which has an array of high data of the high gamma curve and low data of the low gamma curve corresponding to a plurality of sub pixels arranged in an (n×m) matrix array, and a temporal pattern which has a sequence of the high data and the low data respectively corresponding to the sub pixels during k frames ('n', 'm' and 'k' are natural numbers).

When observer's eyes observe the image along the moving direction of the moving object, the Moving Artifact is observed in a side of the moving object such as a Checker defect. The Moving Artifact may be variously viewed according to the moving direction and the moving speed of the moving object.

According to an exemplary embodiment, the gamma data generator 300 may be configured to extract the moving vector of the moving object, to determine the edge area of the moving object, in which the Moving Artifact is observed, based on the moving vector and to decrease a difference between the high data of the high gamma curve and the low data of the low gamma curve applied in the edge area such that the Moving Artifact may be prevented from being observed.

The data driver circuit 400 may be configured to convert the gamma data DOUT received from the gamma data generator 300 into a data voltage for driving the sub pixel of the display panel 100 and to output the data voltage to the data line DL.

The gate driver circuit 500 may be configured to generate a plurality of gate signals and to sequentially output the gate signals to the gate lines GL of the display panel 100.

Figure 2:
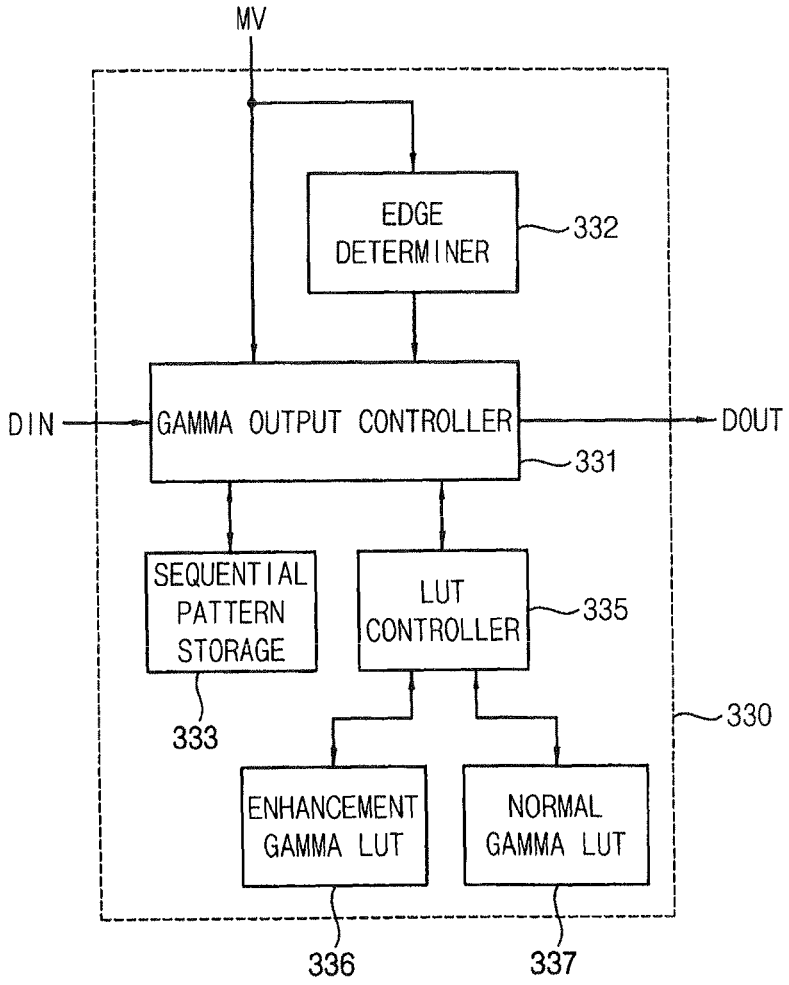
FIG. 2 is a block diagram illustrating a data generator of FIG. 1.

FIG. 2 is a block diagram illustrating a data generator of FIG. 1.

Referring to FIG. 2, the data generator 330 may include a gamma output controller 331, an edge determiner 332, a sequential pattern storage 333, an LUT controller 335, an enhancement gamma LUT 336 and a normal gamma LUT 337.

The gamma output controller 331 may be configured to receive the moving vector MV, and to provide the LUT controller 335 with the moving direction and the moving speed corresponding to the moving vector MV.

The edge determiner 332 may be configured to determine an edge area of the moving object included in a frame image using the moving vector. The edge area may be determined as an area in which the Moving Artifact is observed. For example, when the moving direction of the moving object is a left-horizontal direction, a left edge area of the moving object, in which the Moving Artifact is observed, may be determined as the edge area. Alternatively, when the moving direction of the moving object is a right-horizontal direction, a right edge area of the moving object, in which the Moving Artifact is observed, may be determined as the edge area.

The sequential pattern storage 333 may be configured to store a spatiotemporal sequential pattern, and to provide the gamma output controller 331 with the spatiotemporal sequential pattern. The spatiotemporal sequential pattern is for determining the gamma data of the input data into the high data of the high gamma curve and the low data of the low gamma curve in both time division method and space division method.

For example, the spatiotemporal sequential pattern may include a spatial pattern which has an array of high data of the high gamma curve and low data of the low gamma curve corresponding to a plurality of sub pixels arranged in an (n×m) matrix array, and a temporal pattern which has a sequence of the high data and the low data respectively corresponding to the sub pixels during k frames ('n', 'm' and 'k' are natural numbers).

The LUT controller 335 may be configured to read out the high data of the high gamma curve and the low data of the low gamma curve from the enhancement gamma LUT 336 and the normal gamma LUT 337 based on a control of the gamma output controller 331.

For example, when the input data DIN corresponding to the edge area of the moving object are received, the LUT controller 335 may be configured to read out one of enhanced high data of the high gamma curve and enhanced low data of the low gamma curve corresponding to the input data DIN from the enhancement gamma LUT 336 based on the spatiotemporal sequential pattern. Alternatively, when the input data DIN corresponding to a remaining area of the frame image except for the edge area are received, the LUT controller 335 may be configured to read out one of normal high data of the high gamma curve and normal low data of the low gamma curve corresponding to the input data DIN from the normal gamma LUT 337 based on the spatiotemporal sequential pattern.

The enhancement gamma LUT 336 may be configured to store the enhanced high data of the high gamma curve and the enhanced low data of the low gamma curve corresponding to the input data DIN. The enhancement gamma LUT 336 may be configured to store enhanced high data and enhanced low data corresponding to a plurality of sample grayscales sampled from total grayscales and to calculate enhanced high data and enhanced low data corresponding to remaining grayscales except for the sample grayscales by an interpolation.

The normal gamma LUT 337 may be configured to store the normal high data of the high gamma curve and the normal low data of the low gamma curve corresponding to the input data DIN. The normal gamma LUT 337 may be configured to store normal high data and normal low data corresponding to a plurality of sample grayscales sampled from total grayscales and to calculate normal high data and normal low data corresponding to remaining grayscales except for the sample grayscales by an interpolation.

The enhanced high data and the enhanced low data are determined based on a reference grayscale and the reference grayscale is determined into a grayscale having a maximum luminance difference between the high gamma curve and the low gamma curve.

For example, when the input data has a grayscale higher than the reference grayscale, the enhanced high data are determined into a high grayscale higher than a normal grayscale of the high gamma curve HGC corresponding to the input data and the enhanced low data are determined into a high grayscale higher than a normal grayscale of the low gamma curve LGC corresponding to the input data.

Alternatively, when the input data has a grayscale lower than the reference grayscale, the enhanced high data are determined into a low grayscale lower than a normal grayscale of the high gamma curve HGC corresponding to the input data and the enhanced low data are determined into a low grayscale lower than a normal grayscale of the low gamma curve LGC corresponding to the input data.

Therefore, the enhancement gamma LUT 336 may be configured to output the enhanced high data or the enhanced low data of the high grayscale higher than the normal grayscale of the high gamma curve HGC or the low gamma curve LGC corresponding to the input data when the input data have a grayscale higher than the reference grayscale. Alternatively, the enhancement gamma LUT 336 may be configured to output the enhanced high data or the enhanced low data of the low grayscale lower than the normal grayscale of the high gamma curve HGC or the low gamma curve LGC corresponding to the input data when the input data have a grayscale lower than the reference grayscale. Thus, a luminance difference between the enhanced high data and the enhanced low data may be decreased and thus, the luminance difference in the edge area may be decreased. Therefore, the Moving Artifact such as a Checker defect may be prevented from being observed in the edge area.

FIG. 3 is conceptual diagram illustrating a sequential pattern storage of FIG. 2 according to an exemplary embodiment.

Referring to FIGS. 2 and 3, the spatiotemporal sequential pattern TSP may include a spatial pattern which has an array of high data H of the high gamma curve and low data L of the low gamma curve corresponding to sub pixels SP1, SP2, SP3 and SP4 arranged in a (2×2) matrix array, and a temporal pattern which has a sequence of the high data H and the low data L respectively corresponding to the sub pixels SP1, SP2, SP3 and SP4 during a plurality of frames, for example, 4 frames. The temporal pattern may include a first sequence A and second sequence B. For example, as shown in FIG. 3, the spatial pattern (Spatial pattern) may have a spatial array U of sub pixels arranged in a (4×12) matrix array for increasing driving-efficiency.

Referring to the sub pixels SP1, SP2, SP3 and SP4 arranged in the (2×2) matrix array, a first sub pixel SP1 and a second sub pixel SP2 adjacent to the first sub pixel SP1 in a row direction have a first sequence A, and a third sub pixel SP3 adjacent to the first sub pixel SP1 in a column direction and a fourth sub pixel SP4 adjacent to the third sub pixel SP3 in the row direction have a second sequence B Each of the first and second sequences A and B has a preset sequence with respect to the high data H of the high gamma curve and the low data L of the low gamma curve.

For example, the gamma data DOUT of a sub pixel having the first sequence A has a sequence as "H→L→H→L" during 4 frames with respect to the high data H of the high gamma curve and the low data L of the low gamma curve. According to the first sequence A, the gamma data DOUT of the sub pixel are outputted as the high data H during a first frame F1, are outputted as the low data L during a second frame F2, are outputted as the high data H during a third frame F3, and are outputted as the low data L during a fourth frame F4.

The gamma data DOUT of a sub pixel having the second sequence B has a sequence as "L→H→H" during 4 frames with respect to the high data H of the high gamma curve and the low data L of the low gamma curve. According to the second sequence B, the gamma data DOUT of the sub pixel are outputted as the low data L during a first frame F1, are outputted as the high data H during a second frame F2, are outputted as the low data L during a third frame F3, and are outputted as the high data H during a fourth frame F4.

The temporal spatial patterns of the spatiotemporal sequential pattern TSP may be variously preset according to physical characteristics and driving characteristics of the display panel.

Figures 4A, 4B:
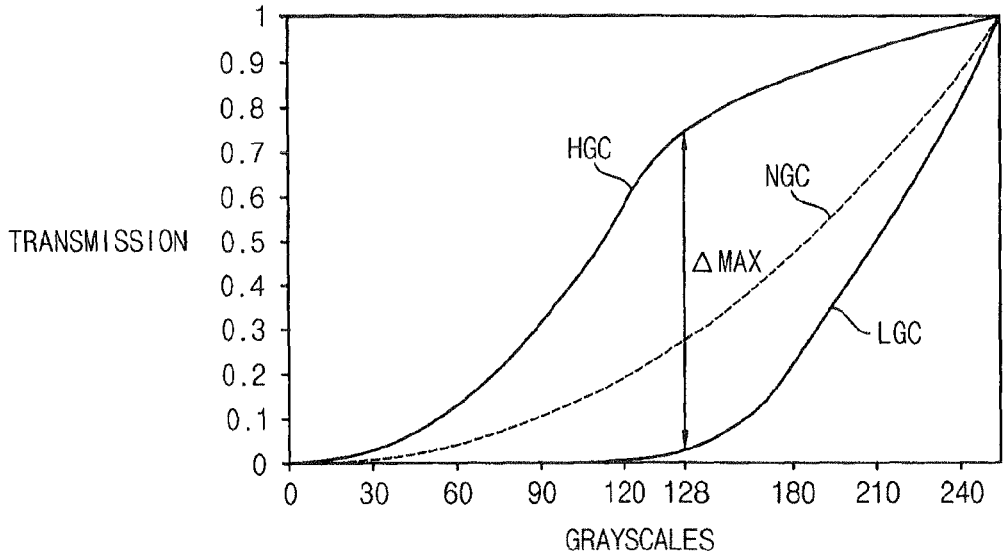

FIGS. 4A to 4C are conceptual diagrams illustrating an enhancement gamma LUT and a normal gamma LUT of FIG. 2 according to an exemplary embodiment.

FIG. 4A is a conceptual diagram illustrating a high gamma curve and a low gamma curve.

As shown in FIG. 4A, in comparison with a normal gamma curve NGC, the high gamma curve HGC has a relatively high luminance in middle grayscales and the low gamma curve LGC has a relatively low luminance in middle grayscales. The grayscale level of the high data H has a transmission based on the high gamma curve HGC and the grayscale level of the low data L has a transmission based on the low gamma curve LGC.

FIG. 4B is a conceptual diagram illustrating a normal gamma LUT.

Referring to FIG. 4B, the normal gamma LUT may be configured to store the normal high data N_H and the normal low data N_L corresponding to sample grayscales on the input data DIN.

For example, when the grayscale level of the input data DIN is a 63-grayscale level 63G, the grayscale level of the normal high data N_H based on the high gamma curve HGC may be a 109-grayscale level 109G and the grayscale level of the normal low data N_L based on the low gamma curve LGC may be a 0-grayscale level 0G.

FIG. 4C is a conceptual diagram illustrating an enhancement gamma LUT.

Referring to FIGS. 4A and 4C, the enhancement gamma LUT may be configured to store the enhanced high data E_H and the enhanced low data E_L corresponding to sample grayscales on the input data DIN.

The reference grayscale is determined as a grayscale having a maximum luminance difference between the high gamma curve HGC and the low gamma curve LGC. As shown in FIG. 4A, a 128-grayscale has the maximum luminance difference between the high gamma curve HGC and the low gamma curve LGC.

When a grayscale of the input data is higher than the reference grayscale of the 128-grayscale, the enhanced high data E_H are determined into a high grayscale higher than a normal grayscale of the high gamma curve HGC corresponding to the input data and the enhanced low data E_L are determined into a high grayscale higher than a normal grayscale of the low gamma curve LGC corresponding to the input data.

Alternatively, when a grayscale of the input data is lower than the reference grayscale of the 128-grayscale 128G, the enhanced high data E_H are determined into a low grayscale lower than a normal grayscale of the high gamma curve HGC corresponding to the input data and the enhanced low data E_L are determined into a low grayscale lower than a normal grayscale of the low gamma curve LGC corresponding to the input data.

For example, referring to FIGS. 4B and 4C, when the input data DIN of the input data is a 63-grayscale 63G lower than the reference grayscale of the 128-grayscale 128G, the enhanced high data E_H is determined into a 30-grayscale 30G lower than a 109-garyscale 109G of the normal high data N_H, and the enhanced low data E_L is determined into a grayscale lower than a 0-garyscale 0G of the normal low data N_L. That is, the enhanced low data E_L may be determined into the 0-garyscale 0G substantially equal to the 0-garyscale 0G of the normal low data N_L.

Alternatively, when the input data DIN of the input data is a 159-grayscale 159G higher than the reference grayscale of the 128-grayscale 128G, the enhanced high data E_H is determined into a 249-grayscale 249G higher than a 239-garyscale 239G of the normal high data N_H, and the enhanced low data E_L is determined into a 200-grayscale 200G higher than a 77-garyscale 77G of the normal low data N_L.

Thus, a luminance difference between the enhanced high data and the enhanced low data may be decreased and thus, the luminance difference in the edge area may be decreased. Therefore, the Moving Artifact such as a Checker defect may be prevented from being observed in the edge area.

Although not shown in figures, the Moving Artifact may be observed in various edge areas according to moving direction and speed of the moving object. Thus, the enhancement gamma LUT may include a plurality of enhancement gamma LUTs which is variously preset according to moving direction and speed of the moving object such that the Moving Artifact in various edge areas may be prevented from being observed.

Figure 5:
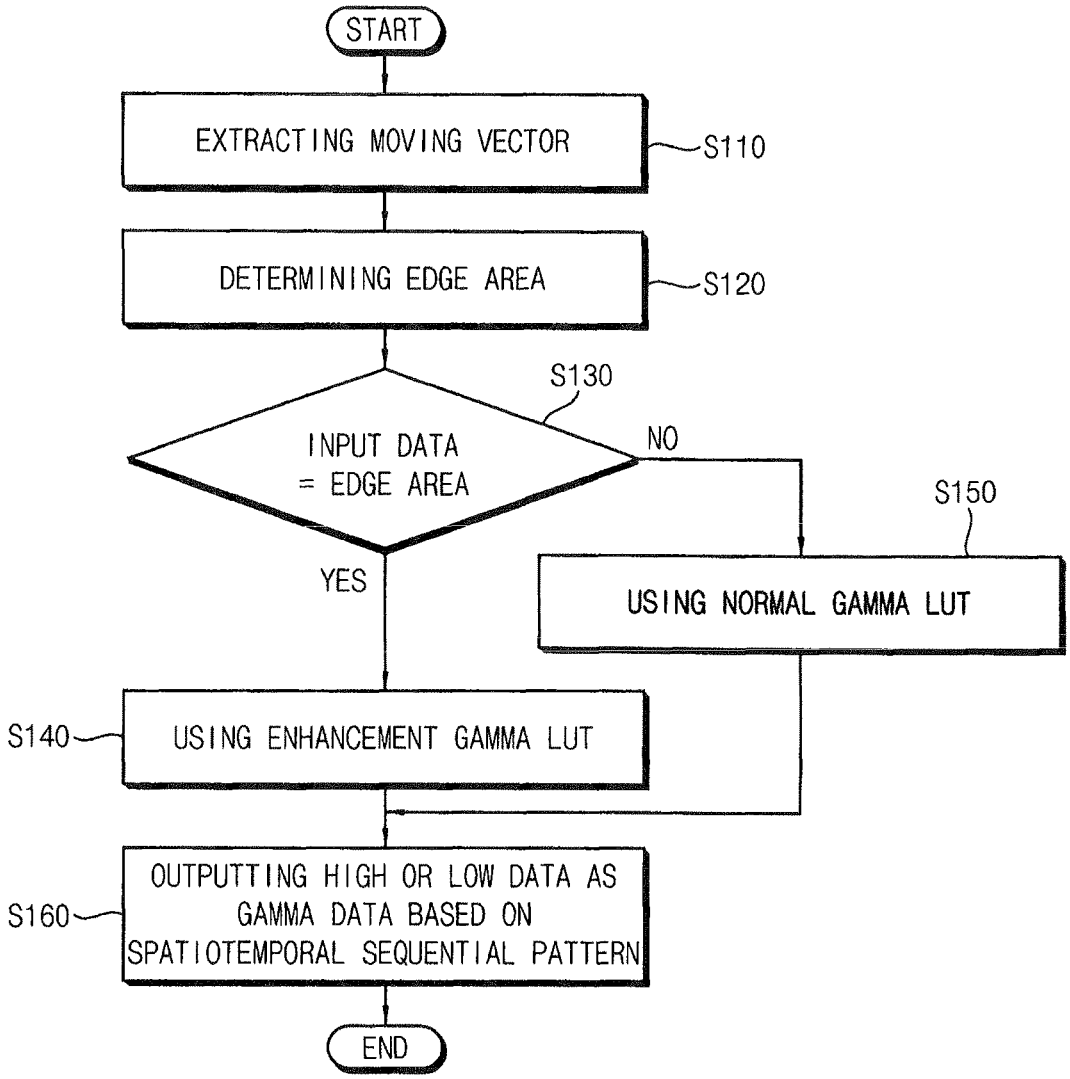
FIG. 5 is a flowchart illustrating a method of driving a display apparatus according to an exemplary embodiment.

FIG. 5 is a flowchart illustrating a method of driving a display apparatus according to an exemplary embodiment.

Referring to FIGS. 1, 2 and 5, the moving vector extractor 310 may be configured to extract a moving vector MV of a moving object included in a frame image using input data DIN (Step S110). For example, the moving vector extractor 310 may be configured to compare current frame data with previous frame data and to extract the moving vector MV of the moving object included in a current frame image. The moving vector MV may be calculated by various algorithms such as a Motion Estimation Motion Compensation (MEMC) algorithm.

The edge determiner 332 may be configured to determine an edge area of the moving object included in the frame image using the moving vector MV (Step S120). The edge area may be determined as an area in which the Moving Artifact is observed. For example, when the moving direction of the moving object is a left-horizontal direction, a left edge area of the moving object, in which the Moving Artifact is observed, may be determined as the edge area. Alternatively, when the moving direction of the moving object is a right-horizontal direction, a right edge area of the moving object, in which the Moving Artifact is observed, may be determined as the edge area.

The gamma output controller 331 may be configured to determine whether the input data DIN corresponds to a sub pixel disposed in the edge area (Step S130).

When the input data DIN correspond to the sub pixel disposed in the edge area, the LUT controller 335 may be configured to read out one of enhanced high data of the high gamma curve and enhanced low data of the low gamma curve corresponding to the input data DIN from the enhancement gamma LUT 336 based on the spatiotemporal sequential pattern (Step S140).

Alternatively, when the input data DIN do not correspond to the sub pixel disposed in the edge area, the gamma output controller 331 may be configured to read out one of normal high data of the high gamma curve and normal low data of the low gamma curve corresponding to the input data DIN from the normal gamma LUT 337 based on the spatiotemporal sequential pattern (Step S150).

When the input data DIN correspond to the sub pixel disposed in the edge area, the gamma output controller 331 may be configured to output the enhanced high data of the high gamma curve or the enhanced low data of the low gamma curve provided from the enhancement gamma LUT 336 based on the spatiotemporal sequential pattern TSP as the gamma data DOUT of the input data DIN (Step S160).

Alternatively, when the input data DIN do not correspond to the sub pixel disposed in the edge area, the gamma output controller 331 may be configured to output the normal high data of the high gamma curve or the normal low data of the low gamma curve based on the spatiotemporal sequential pattern TSP as the gamma data DOUT of the input data DIN (Step S160).

According to an exemplary embodiment, a luminance difference between the enhanced high data and the enhanced low data may be decreased and thus, the luminance difference in the edge area may be decreased. Therefore, the Moving Artifact such as a Checker defect may be prevented from being observed in the edge area.

Figure 6:
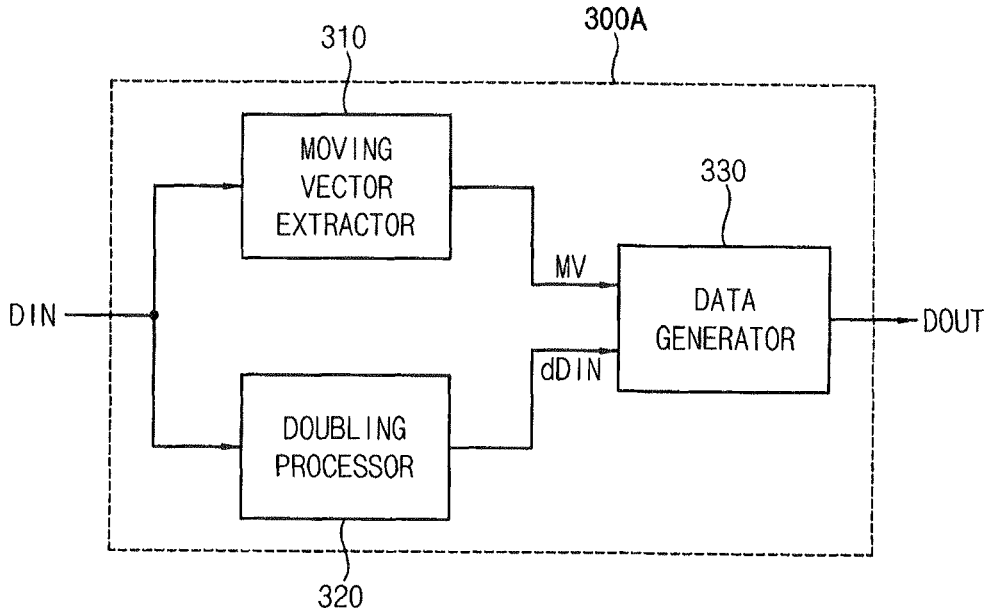
FIG. 6 is a block diagram illustrating a display apparatus according to an exemplary embodiment.

FIG. 6 is a block diagram illustrating a display apparatus according to an exemplary embodiment.

Hereinafter, the same reference numerals are used to refer to the same or like parts as those described in the previous exemplary embodiments, and the same detailed explanations are not repeated unless necessary.

Referring to FIGS. 1 and 6, the display apparatus according to an exemplary embodiment may include a display panel 100, a controller 200, a gamma data generator 300A, a data driver circuit 400 and a gate driver circuit 500.

The gamma data generator 300A may include a moving vector extractor 310, a doubling processor 320 and a data generator 330.

The moving vector extractor 310 may be configured to extract a moving vector MV of an object included in a frame image using input data DIN. For example, the moving vector extractor 310 may be configured to compare current frame data with previous frame data and to extract the moving vector MV of the moving object included in a current frame image. The moving vector MV may be calculated by various algorithm such as a Motion Estimation Motion Compensation (MEMC) algorithm.

The doubling processor 320 may be configured to repeat the input data DIN by a frame period and to sequentially output an original data frame and a repeated data frame which is equal to the original data frame (dDIN). For example, the doubling processor 320 may be configured to receive the original data frame with a frame frequency of 60 Hz, to repeat the original data frame and to sequentially output the original data frame and the repeated data frame with a frame frequency of 120 Hz. The doubling processor 320 may be used when a frame frequency of the display panel is higher than a frame frequency of source image data.

The data generator 330 may be configured to receive the input data dDIN of a high frequency from the doubling processor 320. The data generator 330 may be configured to determine an edge area of a moving object included in an input image based on the moving vector MV.

The data generator 330 may be configured to output high data of a high gamma curve and low data of a low gamma curve in both time division method and space division method as gamma data DOUT of the input data dDIN.

For example, the data generator 330 may be configured to determine whether the input data dDIN correspond to the original data frame or the repeated data frame. When the input data dDIN correspond to the repeated data frame, the data generator 330 may be configured to output normal high data of the high gamma curve and normal low data of the low gamma curve in both time division method and space division as gamma data DOUT of the input data.

When the input data dDIN correspond to the original data frame, the data generator 330 may be configured to determine whether the input data dDIN correspond to the edge area of the moving object.

When the input data dDIN correspond to the edge area of the original data frame, the data generator 330 may be configured to output enhanced high data of the high gamma curve and enhanced low data of the low gamma curve in both time division method and space division method as gamma data DOUT of the input data dDIN.

When the input data dDIN correspond to a remaining area except for the edge area of the original data frame, the data generator 330 may be configured to output normal high data of the high gamma curve and normal low data of the low gamma curve in both time division method and space division method based on the spatiotemporal sequential pattern as gamma data DOUT of the input data dDIN.

The data generator 330 may include the same or like parts as those described in the previous exemplary embodiments. Thus, the data generator 330 may include a gamma output controller 331, an edge determiner 332, a sequential pattern storage 333, an LUT controller 335, an enhancement gamma LUT 336 and a normal gamma LUT 337 as shown in FIG. 2.

The gamma output controller 331 may be configured to receive the moving vector MV and to provide the LUT controller 335 with moving direction and moving speed corresponding to the moving vector MV.

The edge determiner 332 may be configured to determine an edge area of the moving object included in a frame image using the moving vector.

The sequential pattern storage 333 may be configured to store a spatiotemporal sequential pattern, and to provide the gamma output controller 331 with the spatiotemporal sequential pattern. The spatiotemporal sequential pattern is for determining the gamma data of the input data into the high data of the high gamma curve and the low data of the low gamma curve in both time division method and space division method.

For example, the spatiotemporal sequential pattern may include a spatial pattern which has an array of high data of the high gamma curve and low data of the low gamma curve corresponding to a plurality of sub pixels arranged in an (n×m) matrix array, and a temporal pattern which has a sequence of the high data and the low data respectively corresponding to the sub pixels during k frames ('n', 'm' and 'k' are natural numbers).

The LUT controller 335 may be configured to read out the high data of the high gamma curve and the low data of the low gamma curve from the enhancement gamma LUT 336 and the normal gamma LUT 337 based on a control of the gamma output controller 331.

The enhancement gamma LUT 336 may be configured to store the enhanced high data of the high gamma curve and the enhanced low data of the low gamma curve corresponding to the input data DIN. The enhancement gamma LUT 336 may be configured to store enhanced high data and enhanced low data corresponding to a plurality of sample grayscales sampled from total grayscales and to calculate enhanced high data and enhanced low data corresponding to remaining grayscales except for the sample grayscales by an interpolation.

The normal gamma LUT 337 may be configured to store the normal high data of the high gamma curve and the normal low data of the low gamma curve corresponding to the input data DIN. The normal gamma LUT 337 may be configured to store normal high data and normal low data corresponding to a plurality of sample grayscales sampled from total grayscales and to calculate normal high data and normal low data corresponding to remaining grayscales except for the sample grayscales by an interpolation.

The enhanced high data and the enhanced low data are determined based on a reference grayscale and the reference grayscale is determined into a grayscale having a maximum luminance difference between the high gamma curve and the low gamma curve.

For example, when the input data has a grayscale higher than the reference grayscale, the enhanced high data are determined into a high grayscale higher than a normal grayscale of the high gamma curve HGC corresponding to the input data and the enhanced low data are determined into a high grayscale higher than a normal grayscale of the low gamma curve LGC corresponding to the input data.

Alternatively, when the input data has a grayscale lower than the reference grayscale, the enhanced high data are determined into a low grayscale lower than a normal grayscale of the high gamma curve HGC corresponding to the input data and the enhanced low data are determined into a low grayscale lower than a normal grayscale of the low gamma curve LGC corresponding to the input data.

Therefore, the enhancement gamma LUT 336 may be configured to output the enhanced high data or the enhanced low data of the high grayscale higher than the normal grayscale of the high gamma curve HGC or the low gamma curve LGC corresponding to the input data when the input data have a grayscale higher than the reference grayscale. Alternatively, the enhancement gamma LUT 336 may be configured to output the enhanced high data or the enhanced low data of the low grayscale lower than the normal grayscale of the high gamma curve HGC or the low gamma curve LGC corresponding to the input data when the input data have a grayscale lower than the reference grayscale. Thus, a luminance difference between the enhanced high data and the enhanced low data may be decreased and thus, the luminance difference in the edge area may be decreased. Therefore, the Moving Artifact such as a Checker defect may be prevented from being observed in the edge area.

Figure 7:
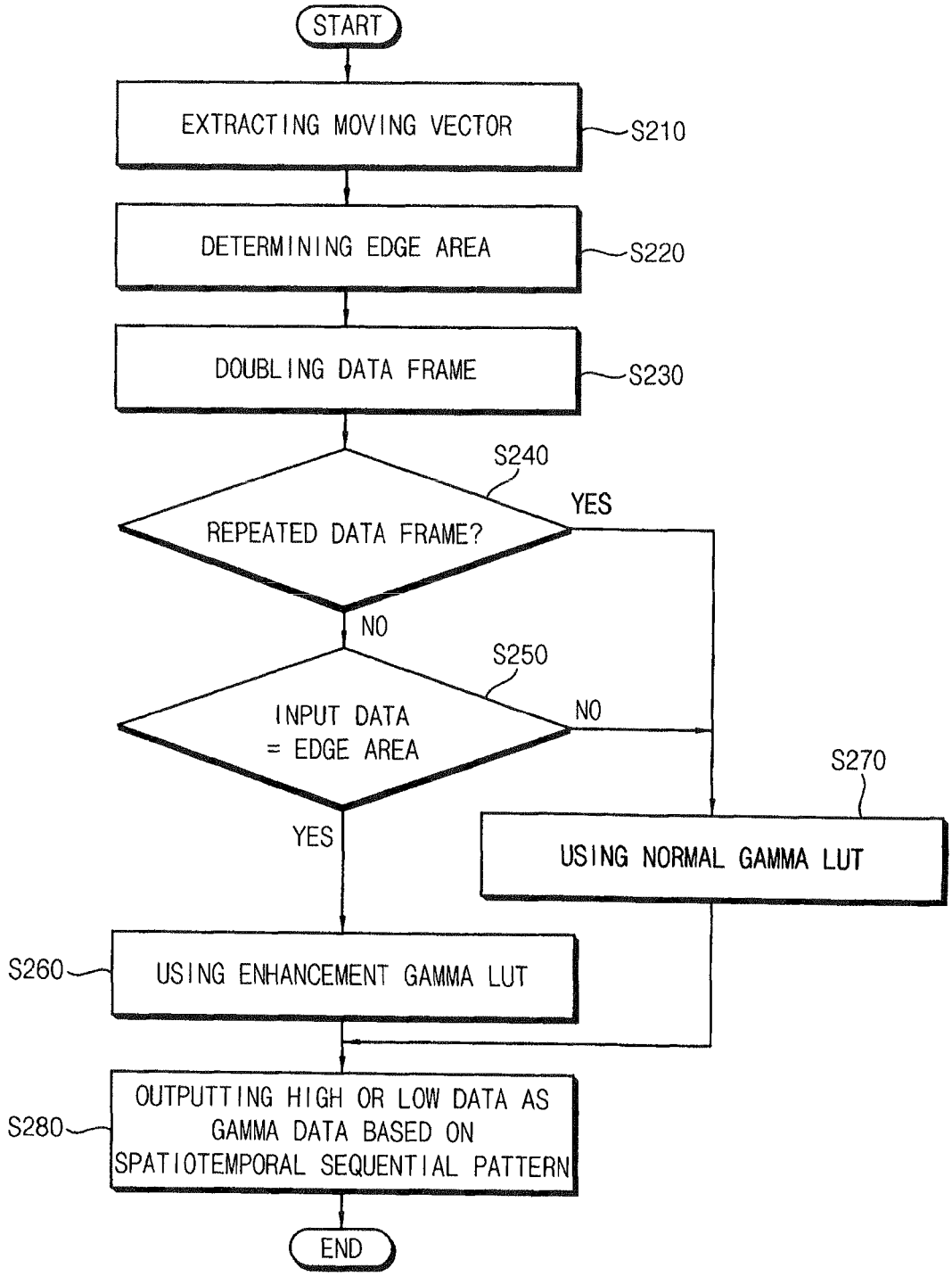
FIG. 7 is a flowchart illustrating a method of driving the display apparatus of FIG. 6.

FIG. 7 is a flowchart illustrating a method of driving the display apparatus of FIG. 6.

Referring to FIGS. 1, 2, 5, 6 and 7, the moving vector extractor 310 the moving vector extractor 310 may be configured to extract a moving vector MV of an object included in a frame image using input data DIN (Step S210). For example, the moving vector extractor 310 may be configured to compare current frame data with previous frame data and to extract the moving vector MV of the moving object included in a current frame image. The moving vector MV may be calculated by various algorithm such as a Motion Estimation Motion Compensation (MEMC) algorithm.

The edge determiner 332 may be configured to determine an edge area of the moving object included in the frame image using the moving vector MV (Step S220).

The doubling processor 320 may be configured to repeat the input data dDIN by a frame period and to sequentially output an original data frame and a repeated data frame which is equal to the original data frame (Step S230).

The gamma output controller 331 may be configured to determine whether the input data dDIN correspond to the original data frame or the repeated data frame (Step S240).

When the input data dDIN correspond to the repeated data frame, the gamma output controller 331 may be configured to control the LUT controller 335 and the LUT controller 335 may be configured to read out the normal high data or the normal low data from the normal gamma LUT 337 (Step S270).

When the input data dDIN correspond to the original data frame, the data generator 330 may be configured to determine whether the input data dDIN correspond to the edge area of the moving object (Step S250).

When the input data dDIN correspond to the edge area of the original data frame, the gamma output controller 331 may be configured to control the LUT controller 335 and the LUT controller 335 may be configured to read out the enhanced high data or the enhanced low data from the enhancement gamma LUT 336 (Step S260).

When the input data dDIN do not correspond to the remaining area except for the edge area of the original data frame, the gamma output controller 331 may be configured to control the LUT controller 335 and the LUT controller 335 may be configured to read out the normal high data or the normal low data from the normal gamma LUT 337 (Step S270).

Each of the enhancement gamma LUT 336 and the normal gamma LUT 337 may be configured to store the high data and the low data corresponding to a plurality of sample grayscales sampled from total grayscales and to calculate the high data and the low data corresponding to remaining grayscales except for the sample grayscales by an interpolation.

When the input data DIN correspond to the repeated data frame, the gamma output controller 331 may be configured to output the normal high data or the normal low data provided from the normal gamma LUT 337 based on the spatiotemporal sequential pattern TSP as the gamma data DOUT of the input data dDIN (Step S280).

When the input data dDIN correspond to the edge area of the original data frame, the gamma output controller 331 may be configured to output the enhanced high data or the enhanced low data provided from the enhancement gamma LUT 336 based on the spatiotemporal sequential pattern TSP as the gamma data DOUT of the input data dDIN (Step S280).

When the input data dDIN do not correspond to the remaining area except for the edge area of the original data frame, the gamma output controller 331 may be configured to output the normal high data or the normal low data provided from the normal gamma LUT 337 based on the spatiotemporal sequential pattern TSP as the gamma data DOUT of the input data dDIN (Step S280).

According to an exemplary embodiment, a luminance difference between the enhanced high data and the enhanced low data may be decreased and thus, the luminance difference in the edge area may be decreased. Therefore, the Moving Artifact such as a Checker defect may be prevented from being observed in the edge area.

Figure 8A:
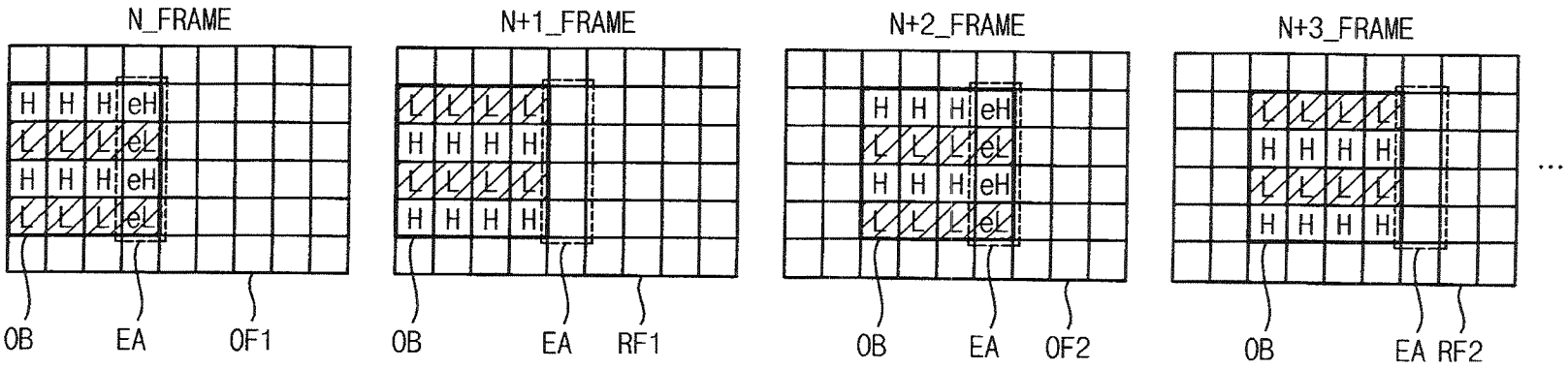
FIGS. 8A and 8B are conceptual diagrams illustrating the method of FIG. 7.
Figure 8B:
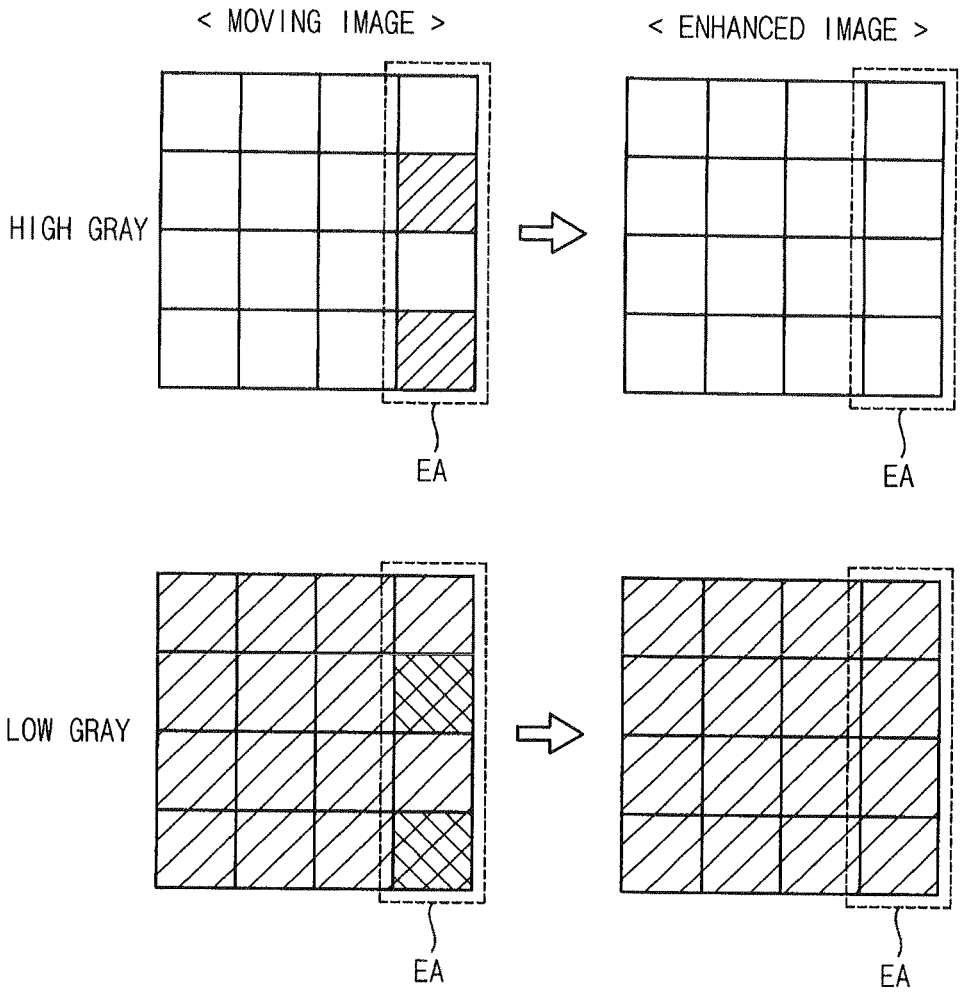

FIGS. 8A and 8B are conceptual diagrams illustrating the method of FIG. 7.

Referring to FIGS. 6 and 8A, the doubling processor 320 may be configured to repeat the original data frame with a low frequency and to output the original data frame and the repeated data frame with a high frequency. The data generator 330 is output the high data of the high gamma curve or the low data of the low gamma curve based on the spatiotemporal sequential pattern as the gamma data of the input data of each of the original data frame and the repeated data frame provided from the doubling processor 320.

Hereinafter, the frame frequency of the original data frame may be referred to as 60 Hz, the moving direction of the moving object OB included in the original data frame may be referred to as a horizontal direction, and the moving speed of the moving object OB may be referred to as 1 ppf with respect to a frame frequency of 60 Hz (or 2 ppf with respect to a frame frequency of 120 Hz).

During an N-th frame (N_Frame), the doubling processor 320 may be configured to output a first original data frame OF1. The data generator 330 may be configured to output the enhanced high data eH of the high gamma curve or the enhanced low data eL of the low gamma curve based on the spatiotemporal sequential pattern as shown in FIG. 3 as the gamma data of the input data corresponding to the edge area EA of the moving object OB. Then, the data generator 330 may be configured to output the normal high data H of the high gamma curve or the normal low data L of the low gamma curve based on the spatiotemporal sequential pattern as shown in FIG. 3 as the gamma data of the input data corresponding to the remaining area except for the edge area EA of the first original data frame OF1.

During an (N+1)-th frame (N+1_Frame), the doubling processor 320 may be configured to output a first repeated data frame RF1 repeating the first original data frame OF1. The data generator 330 may be configured to output the normal high data H of the high gamma curve or the normal low data L of the low gamma curve based on the spatiotemporal sequential pattern as shown in FIG. 3 as the gamma data of the input data of the first repeated data frame RF1. During the (N+1)-th frame (N+1_Frame), a background image is displayed on the edge area EA of the moving object OB and thus, the input data of the edge area EA may be no necessity to enhance.

During an (N+2)-th frame (N+2_Frame), the doubling processor 320 may be configured to output a second original data frame OF2. The data generator 330 may be configured to output the enhanced high data eH of the high gamma curve or the enhanced low data eL of the low gamma curve based on the spatiotemporal sequential pattern as shown in FIG. 3 as the gamma data of the input data corresponding to the edge area EA of the moving object OB. Then, the data generator 330 may be configured to output the normal high data H of the high gamma curve or the normal low data L of the low gamma curve based on the spatiotemporal sequential pattern as shown in FIG. 3 as the gamma data of the input data corresponding to the remaining area except for the edge area EA of the second original data frame OF2. The edge area EA of the second original data frame OF2 is shifted by 2 pixels with respect to the edge area EA of the first original data frame OF1 displayed during the N-th frame (N_FRAME).

During an (N+3)-th frame (N+3_Frame), the doubling processor 320 may be configured to output a second repeated data frame RF2 repeating the second original data frame OF2. The data generator 330 may be configured to output the normal high data H of the high gamma curve or the normal low data L of the low gamma curve based on the spatiotemporal sequential pattern as shown in FIG. 3 as the gamma data of the input data of the second repeated data frame RF2. During the (N+3)-th frame (N+3_Frame), a background image is displayed on the edge area EA of the moving object OB and thus, the input data of the edge area EA may be no necessity to enhance.

As described above, the luminance may be enhanced in the edge area EA of the moving object OB and thus, the Moving Artifact such as a Checker defect may be prevented from being observed in the edge area as shown in FIG. 8B.

Referring to FIG. 8B, when the input data have a high grayscale higher than the reference grayscale, a luminance of the edge area EA may be enhanced into a high luminance and when the input data have a low grayscale lower than the reference grayscale, the luminance of the edge area EA may be enhanced into a low luminance, and thus, the Moving Artifact such as the Checker defect may be prevented from being observed in the edge area.

As described above, according to exemplary embodiments, a luminance difference between the enhanced high data and the enhanced low data applied to the gamma data corresponding to the edge area of the moving object may be decreased and thus, the luminance difference in the edge area of the moving object may be decreased. Therefore, the Moving Artifact such as the Checker defect may be prevented from being observed in the edge area.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus having a display panel comprising a data line, a gate line crossing the data line and a sub pixel connected to the data line and the gate line, the display apparatus comprising:

a moving vector extractor configured to extract a moving vector of a moving object included in a frame image using input data;

an edge determiner configured to determine an edge area of the moving object based on moving direction and moving speed corresponding to the moving vector;

a gamma output controller configured to output normal high data of a high gamma curve and normal low data of a low gamma curve as gamma data of input data corresponding to a remaining area except for the edge area, and to output enhanced high data of the high gamma curve and enhanced low data of the low gamma curve as gamma data of input data corresponding to the edge area, in both time division method and space division method based on a spatiotemporal sequential pattern; and a data driver circuit configured to covert the gamma data provided from the gamma output controller into a data voltage to provide the data line with the data voltage, wherein an enhanced data difference between the enhanced high data and the enhanced low data is equal to or less than a normal data difference between the normal high data and the normal low data with respect to a same grayscale.

2. The display apparatus of claim 1, further comprising:

a sequential pattern storage configured to store the spatiotemporal sequential pattern;

a normal gamma look up table (LUT) configured to store the normal high data of the high gamma curve and the normal low data of the low gamma curve; and an enhancement gamma LUT configured to store the enhanced high data of the high gamma curve and the enhanced low data of the low gamma curve.

3. The display apparatus of claim 2, wherein when the input data has a grayscale higher than a reference grayscale having a maximum luminance difference between the high gamma curve and the low gamma curve, the enhanced high data has a grayscale higher than the normal high data and the enhanced low data has a grayscale higher than the normal low data.

4. The display apparatus of claim 3, wherein when the input data has a grayscale lower than the reference grayscale, the enhanced high data has a grayscale lower than the normal high data and the enhanced low data has a grayscale lower than the normal low data.

5. The display apparatus of claim 1, further comprising:

a doubling processor configured to repeat the input data by a frame period, and to output an original data frame and a repeated data frame substantially equal to the original data frame.

6. The display apparatus of claim 5, wherein when the input data correspond to the repeated data frame, the gamma output controller is configured to output the normal high data of the high gamma curve and the normal low data of the low gamma curve as gamma data of the input data corresponding to the edge area in both time division method and space division method based on the spatiotemporal sequential pattern.

7. The display apparatus of claim 6, wherein when the input data correspond to the original data frame, the gamma output controller is configured to output the normal high data of the high gamma curve and the normal low data of the low gamma curve as gamma data of input data corresponding to a remaining area except for the edge area, and to output the enhanced high data of the high gamma curve and the enhanced low data of the low gamma curve as gamma data of input data corresponding to the edge area, in both time division method and space division method based on the spatiotemporal sequential pattern.

8. The display apparatus of claim 6, wherein the doubling processor is configured to receive data with a frame frequency of 60 Hz and output data with a frame frequency of 120 Hz.

9. The display apparatus of claim 8, wherein the moving speed of the moving object is 1 ppf (pixel per frame) with respect to the frame frequency of 60 Hz and is 2 ppf with respect to the frame frequency of 120 Hz.

10. The display apparatus of claim 1, wherein the spatiotemporal sequential pattern comprises a spatial pattern which has an array of the high and low data corresponding to a plurality of sub pixels arranged in an (n×m) matrix array, and a temporal pattern which has a sequence of the high and low data corresponding to the sub pixels during k frames ('n', 'm' and 'k' are natural numbers).

11. The display apparatus of claim 10, wherein the spatiotemporal sequential pattern corresponds to first to fourth sub pixels arranged in a (2×2) matrix array, a first sub pixel and a second sub pixel adjacent to the first sub pixel in a row direction have a first sequence with respect to high data (H) of the high gamma curve and low data (L) of the low gamma curve during a plurality of frames, and a third sub pixel adjacent to the first sub pixel in a column direction and a fourth sub pixel adjacent to the third sub pixel in the row direction have a second sequence with respect to the high data (H) of the high gamma curve and the low data (L) of the low gamma curve during a plurality of frames.

12. The display apparatus of claim 11, wherein the first sequence has a sequence as "H→L→H→L" with respect to the high and low data (H and L) during 4 frames, and the second sequence has a sequence as "L→H→L→H" with respect to the high and low data (H and L) during 4 frames.

13. A method of driving a display apparatus, comprising:

extracting a moving vector of a moving object included in a frame image using input data;

determining an edge area of the moving object based on moving direction and moving speed corresponding to the moving vector;

outputting normal high data of a high gamma curve and normal low data of a low gamma curve as gamma data of input data corresponding to a remaining area except for the edge area in both time division method and space division method based on a spatiotemporal sequential pattern;

outputting enhanced high data of the high gamma curve and enhanced low data of the low gamma curve as gamma data of input data corresponding to the edge area in both time division method and space division method based on the spatiotemporal sequential pattern; and converting the gamma data into a data voltage to provide the data line with the data voltage, wherein an enhanced data difference between the enhanced high data and the enhanced low data is less than a normal data difference between the normal high data and the normal low data with respect to the input data of a same grayscale.

14. The method of claim 13, wherein when the input data has a grayscale higher than a reference grayscale having a maximum luminance difference between the high gamma curve and the low gamma curve, the enhanced high data has a grayscale higher than the normal high data and the enhanced low data has a grayscale higher than the normal low data.

15. The method of claim 14, wherein when the input data has a grayscale lower than the reference grayscale, the enhanced high data has a grayscale lower than the normal high data and the enhanced low data has a grayscale lower than the normal low data.

16. The method of claim 13, further comprising:

repeating the input data by a frame period to output an original data frame and a repeated data frame substantially equal to the original data frame.

17. The method of claim 16, wherein when the input data are data of the repeated data frame, the normal high data of the high gamma curve and the normal low data of the low gamma curve are outputted as gamma data of the input data corresponding to the edge area in both time division method and space division method based on the spatiotemporal sequential pattern.

18. The method of claim 16, wherein the original data frame and the repeated data frame are outputted with a frame frequency of 120 Hz.

19. The method of claim 18, wherein the moving speed of the moving object is 1 ppf (pixel per frame) with respect to the frame frequency of 60 Hz and is 2 ppf with respect to the frame frequency of 120 Hz.

20. The method of claim 18, wherein the spatiotemporal sequential pattern corresponds to first to fourth sub pixels arranged in a (2×2) matrix array, a first sub pixel and a second sub pixel adjacent to the first sub pixel in a row direction have a first sequence with respect to high data (H) of the high gamma curve and low data (L) of the low gamma curve during 4 frames, the first sequence having a sequence as "H→L→H→L", and a third sub pixel adjacent to the first sub pixel in a column direction and a fourth sub pixel adjacent to the third sub pixel in the row direction have a second sequence with respect to the high data (H) of the high gamma curve and the low data (L) of the low gamma curve during 4 frames, the second sequence having a sequence as "L→H→L→H".

* * * * *